US009890795B2

(12) United States Patent
Chang et al.

(10) Patent No.: US 9,890,795 B2
(45) Date of Patent: Feb. 13, 2018

(54) COOLING FAN STRUCTURE

(71) Applicant: ASIA VITAL COMPONENTS CO., LTD., New Taipei (TW)

(72) Inventors: Bor-Haw Chang, New Taipei (TW); Chung-Shu Wang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 351 days.

(21) Appl. No.: 14/705,948

(22) Filed: May 6, 2015

(65) Prior Publication Data

US 2016/0327060 A1 Nov. 10, 2016

(51) Int. Cl.
*F04D 29/54* (2006.01)
*F04D 19/00* (2006.01)
*F04D 29/64* (2006.01)

(52) U.S. Cl.
CPC ..... *F04D 29/542* (2013.01); *F04D 19/007* (2013.01); *F04D 29/646* (2013.01)

(58) Field of Classification Search
CPC .. F04D 19/007; F04D 25/0613; F04D 29/542; F04D 29/646
See application file for complete search history.

(56) References Cited

U.S. PATENT DOCUMENTS 2,037,395 A * 4/1936 Seelig ..... F04D 19/007 415/160
RE25,569 E * 5/1964 Coron ..... F04D 29/646 415/127
6,537,019 B1 3/2003 Dent
6,827,549 B1 12/2004 Horng et al.
7,156,611 B2 * 1/2007 Oosawa ..... F04D 19/007 415/199.5
7,588,417 B2 * 9/2009 Maniglier ..... F04D 19/042 415/193
7,630,201 B2 12/2009 Asahi
8,241,011 B2 * 8/2012 Huang ..... F04D 19/007 310/112
2003/0075396 A1 4/2003 Brown et al.
2009/0290984 A1 11/2009 Miyabara et al.

FOREIGN PATENT DOCUMENTS

TW 201416560 A 5/2014

* cited by examiner

*Primary Examiner* — Craig Kim
*Assistant Examiner* — Jason Fountain
(74) *Attorney, Agent, or Firm* — C. G. Mersereau; Nikolai & Mersereau, P.A.

(57) ABSTRACT

A cooling fan structure includes a housing, a multistage fan wheel, and a stator-blade unit set. The housing is integrally formed and includes a first and a second frame, and a connecting spacer set connected to between the first and the second frame to define an open space therebetween. The multistage fan wheel is located in the housing and has a hub, around which a group of first and a group of second rotor blades are formed and axially spaced to define a bladeless zone on the hub between the first and the second rotor blades. The stator-blade unit set includes a first and a second stator-blade unit, which are assembled into the open space of the housing to circumferentially close the open space. The stator-blade unit set is exchangeable according to different high impedance systems to achieve different levels of high static pressure without increasing any mold-making cost.

8 Claims, 12 Drawing Sheets

COOLING FAN STRUCTURE

FIELD OF THE INVENTION

The present invention relates to a cooling fan structure, and more specifically, to a cooling fan structure including a stator-blade unit set that is exchangeable according to different high impedance systems to achieve different levels of high static pressure without increasing any mold-making cost.

BACKGROUND OF THE INVENTION

As the advancement of electronic industry, various electronic elements now produce more heat than before when they operate. Therefore, natural convection is no longer sufficient for removing waste heat. In order to lower the temperature in a computer system, more than one cooling fan is generally disposed in the computer system to dissipate the heat produced by the electronic elements of the computer system. Normally, the cooling fans are mainly installed close to the heat-generating elements to lower the temperature thereof. Alternatively, the cooling fans are installed at an air inlet or an air outlet to facilitate flowing of air in the computer system. Thus, cooling fans have now become an indispensable part in the computer systems.

Please refer to FIGS. 1 and 2, which are perspective views of two conventional single-rotor blade fans 1. As shown, the single-rotor blade fan 1 has a rotor 10 and a stator 11. The rotor 10 includes a fan blade unit 101 having a row of fan blades spaced on a periphery thereof, whereas the stator 11 has a plurality of stator blades 111, as shown in FIG. 1, or ribs 112, as shown in FIG. 2, spaced on a periphery thereof. With theses arrangements, the single-rotor blade fan causes the air to flow out of the fan blade unit 101 of the rotor 10 at an angle against the stator blades 111, so that the airflow turns to work and the fan 1 provides improved heat dissipation effect. However, the single-rotor blade fan 1, due to its design, has relatively low pressure in the high back pressure zone, and accordingly, has relatively poor heat dissipation effect when being used with high impedance systems.

Please refer to FIG. 3, a fan module 2 is disclosed to include a housing 20, a first and a second set of stator blades 21, 22, a motor 23, and a rotor blade unit 24. The housing 20 has a passage 25, two ends of which respectively form an air inlet 251 and an air outlet 252. The first and second set of stator blades 21, 22 are provided on an inner wall surface of the housing 20 and located in the passage 25. The motor 23 is arranged in the passage 25 and has a rotor 26. The rotor blade unit 24 includes a hub 241, a first and a second set of rotor blades 242, 243. The hub 241 is fixedly mounted around the rotor 26. The first and second sets of rotor blades 242, 243 are circumferentially spaced on the hub 241. The first set of rotor blades 242 is located between the air inlet 251 and the first set of stator blades 21, whereas the second set of rotor blades 243 is located between the first and the second set of stator blades 21, 22. However, the above-mentioned structure does not disclose how the first set of rotor blades 242 is arranged between the air inlet 251 of the housing 20 and the first set of stator blades 21, nor does it disclose how the second rotor blades 243 are arranged between the first set of stator blades 21 and the second set of stator blades 22. Therefore, a person of ordinary skill in the art just could not implement the fan module 2 according to the above-mentioned structure.

SUMMARY OF THE INVENTION

To solve the above problems, a primary object of the present invention is to provide a cooling fan structure including a stator-blade unit set that is exchangeable according to different impedance systems to achieve different levels of static pressure.

Another object of the present invention is to provide a cooling fan structure that largely saves the fan's mold-making cost.

A further object of the present invention is to provide a practicable cooling fan structure.

A still further object of the present invention is to provide a cooling fan assembling method that enables a cooling fan structure to have a stator-blade unit set exchangeable according to different impedance systems to achieve different levels of static pressure.

A still further object of the present invention is to provide a cooling fan assembling method that enables the assembled cooling fan structure to exchange a stator-blade unit set with another one without increasing any mold-making cost.

A still further object of the present invention is to provide a cooling fan assembling method that includes practicable steps for assembling a cooling fan structure.

To achieve the above and other objects, the cooling fan structure provided according to the present invention includes a housing, a multistage fan wheel, and a stator-blade unit set. The housing is integrally formed and includes a first frame, a second frame, and a connecting spacer set connected to between the first and second frames to space them apart by a predetermined distance and define an open space therebetween. The first frame internally defines a first receiving space, whereas the second frame internally defines a second receiving space; and the first and the second receiving space are axially communicable with the open space. The multistage fan wheel is located is in the housing and includes a hub, around which a group of first rotor blades and a group of second rotor blades are formed and axially spaced, such that a bladeless zone is defined on the hub between the first and the second rotor blades. The first rotor blades are located in the first receiving space, the second rotor blades are located in the second receiving space, and the bladeless zone is located in the open space. The stator-blade unit set includes a first and a second stator-blade unit, which are radially removably assembled into the open space of the housing to circumferentially close the open space. The first and the second stator-blade unit respectively have a first and a second inner wall surface and a first and a second free end. A plurality of first air-guiding members is provided on the first inner wall surface to radially extend into the open space, whereas a plurality of second air-guiding members is provided on the second inner wall surface to radially extend into the open space; and the first and the second free end are located in the open space corresponding to the bladeless zone of the multistage fan wheel.

To achieve the above and other objects, the cooling fan assembling method provided according to the present invention includes the following steps:

Provide a housing. The housing includes a first and a second frame, and a connecting spacer set connected to between the first and the second frame to define an open space therebetween. The first frame internally defines a first receiving space, whereas the second frame internally defines a second receiving space; and the first and the second receiving space are axially communicable with the open space.

Fit a multistage fan wheel in the housing. The multistage fan wheel includes a hub, around which a group of first rotor blades and a group of second rotor blades are formed and axially spaced to define a bladeless zone therebetween, such that the first rotor blades are located in the first receiving space, the second rotor blades are located in the second receiving space, and the bladeless zone is located in the open space.

Provide a stator-blade unit set. The stator-blade unit set includes a first and a second stator-blade unit, which are radially removably assembled into the open space of the housing to circumferentially close the open space, so that the stator-blade unit set and the housing together form an integral body.

When assembling the cooling fan according to the method of the present invention, first fit the multistage fan wheel in the housing; and then, provide the first and the second stator-blade unit and radially assemble them into the open space of the housing to close the open space, so that the stator-blade unit set and the housing together form an integral body. In this way, the stator-blade unit set is freely exchangeable according to different high impedance systems to achieve different levels of high static pressure. Therefore, in the present invention, unlike the conventional cooling fan structures, the cost of making a whole new mold for forming another fan frame with a different stator-blade unit set can be saved.

Compared to Taiwan Invention Patent Pub. No. 201416560A, the present invention has provided clear steps, based on which a person of ordinary skill in the art can assemble the stator-blade unit set to the housing to form the cooling fan structure while achieving the aforesaid effects.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
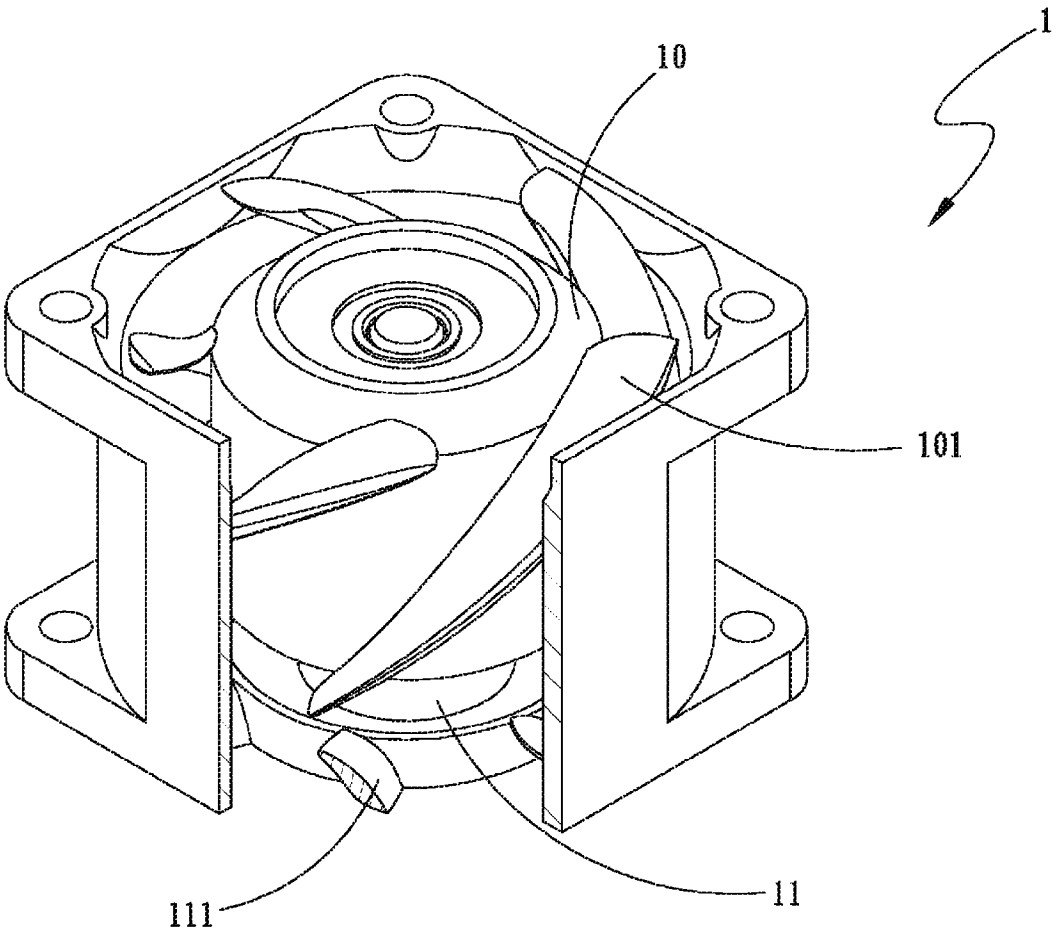
(PRIOR ART) Fig. 1
FIG. 1 is an assembled, partially sectioned perspective view of a first conventional cooling fan structure.
Figure 2:
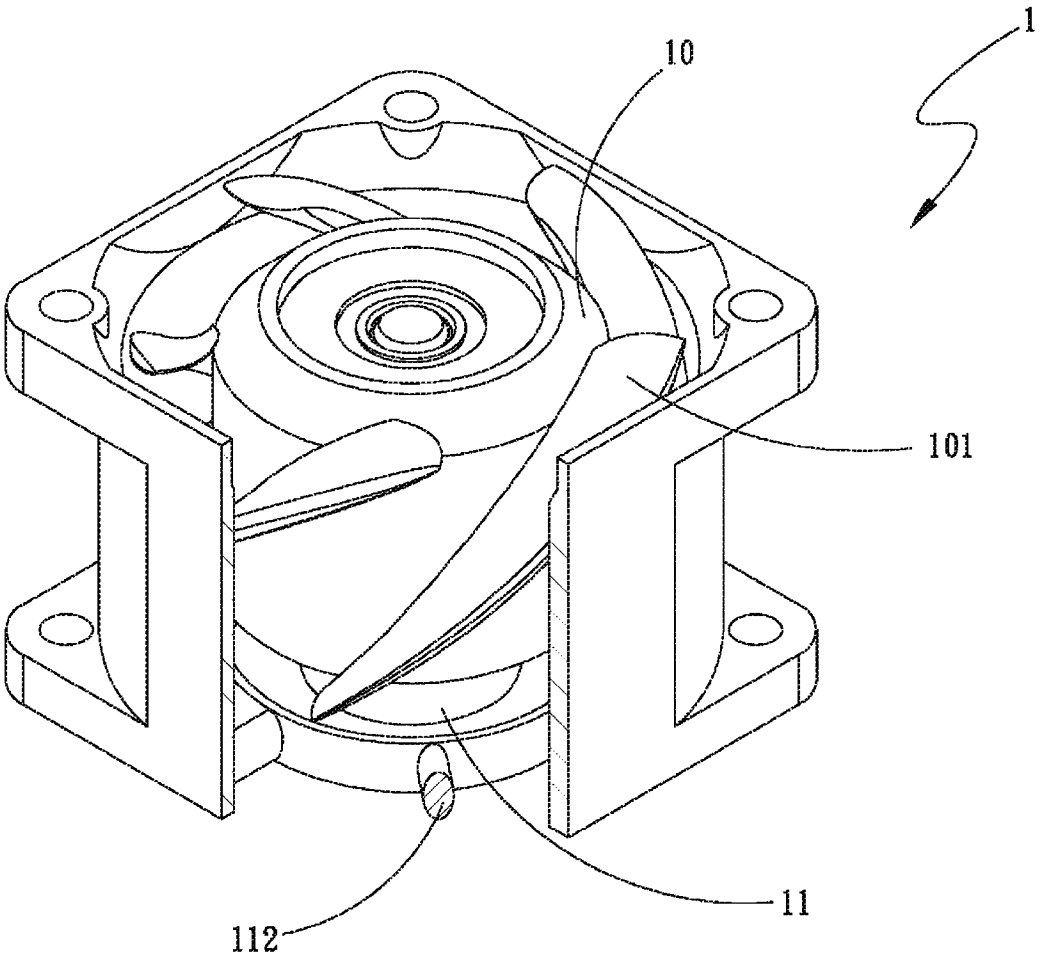
(PRIOR ART) Fig. 2
FIG. 2 is an assembled, partially sectioned perspective view of a second conventional cooling fan structure.
Figure 3:
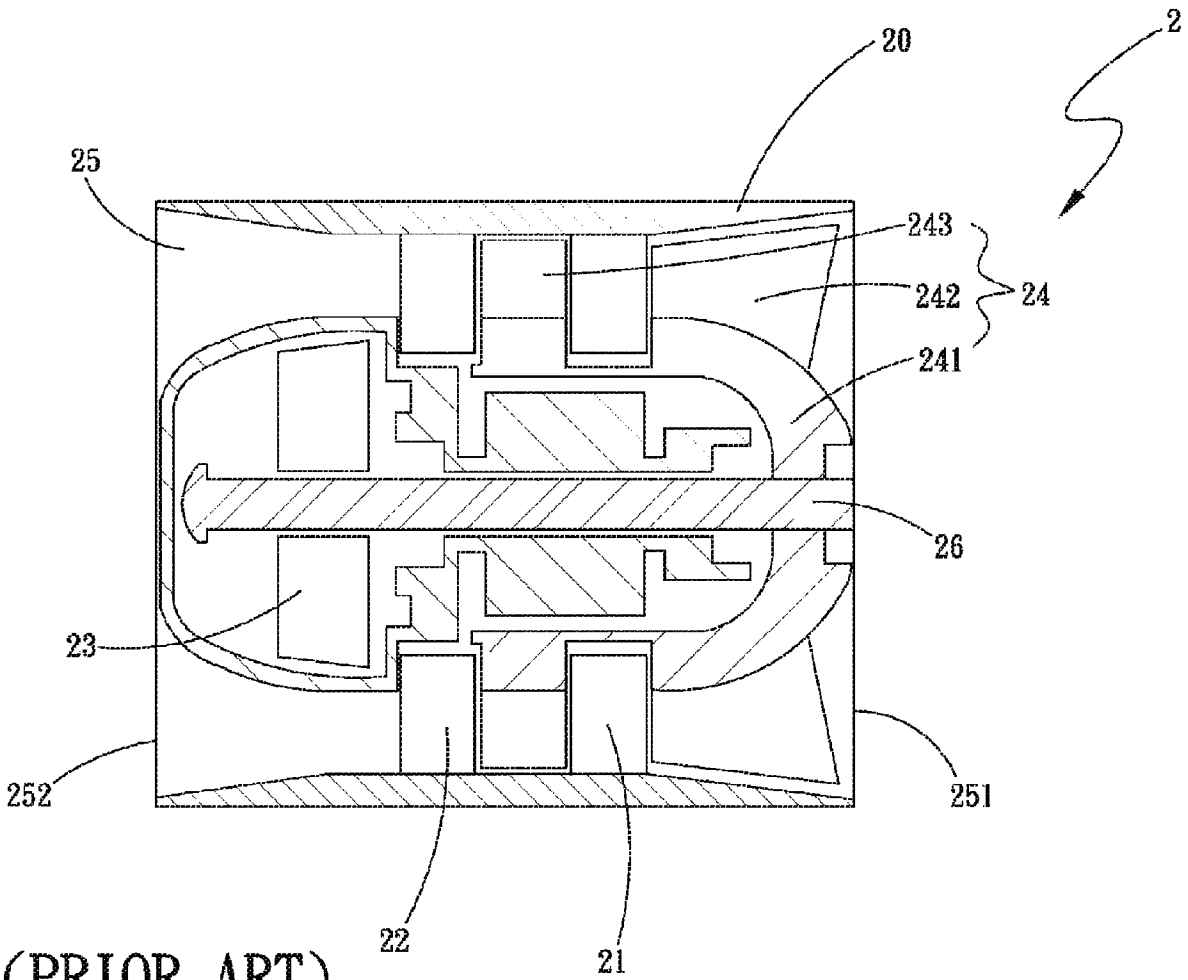
Fig. 3 (PRIOR ART)
FIG. 3 is an assembled sectional view of a third conventional cooling fan structure.
Figure 4A:
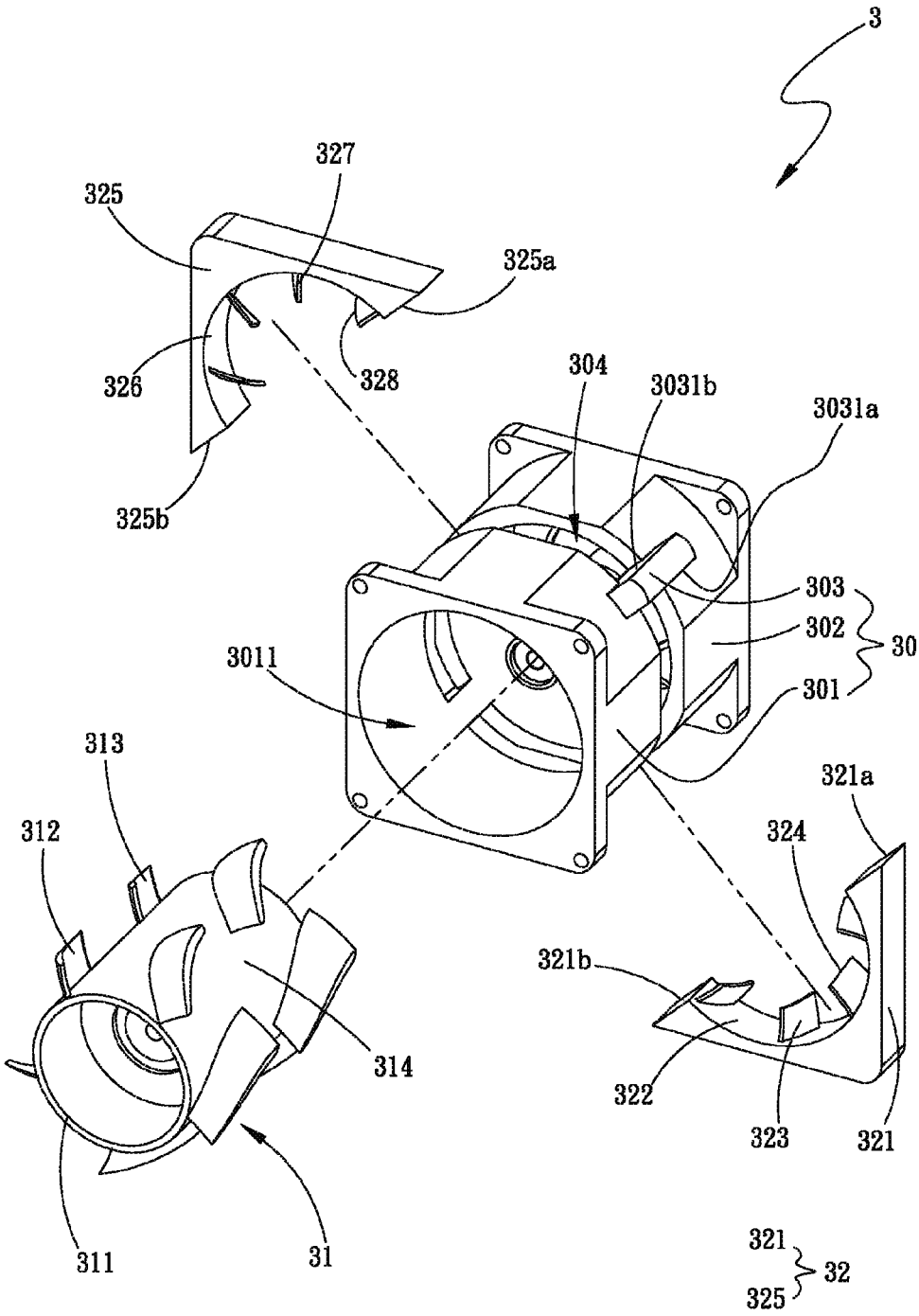
FIG. 4A is an exploded perspective view of a cooling fan structure of the present invention according to a first embodiment thereof.
Figure 4B:
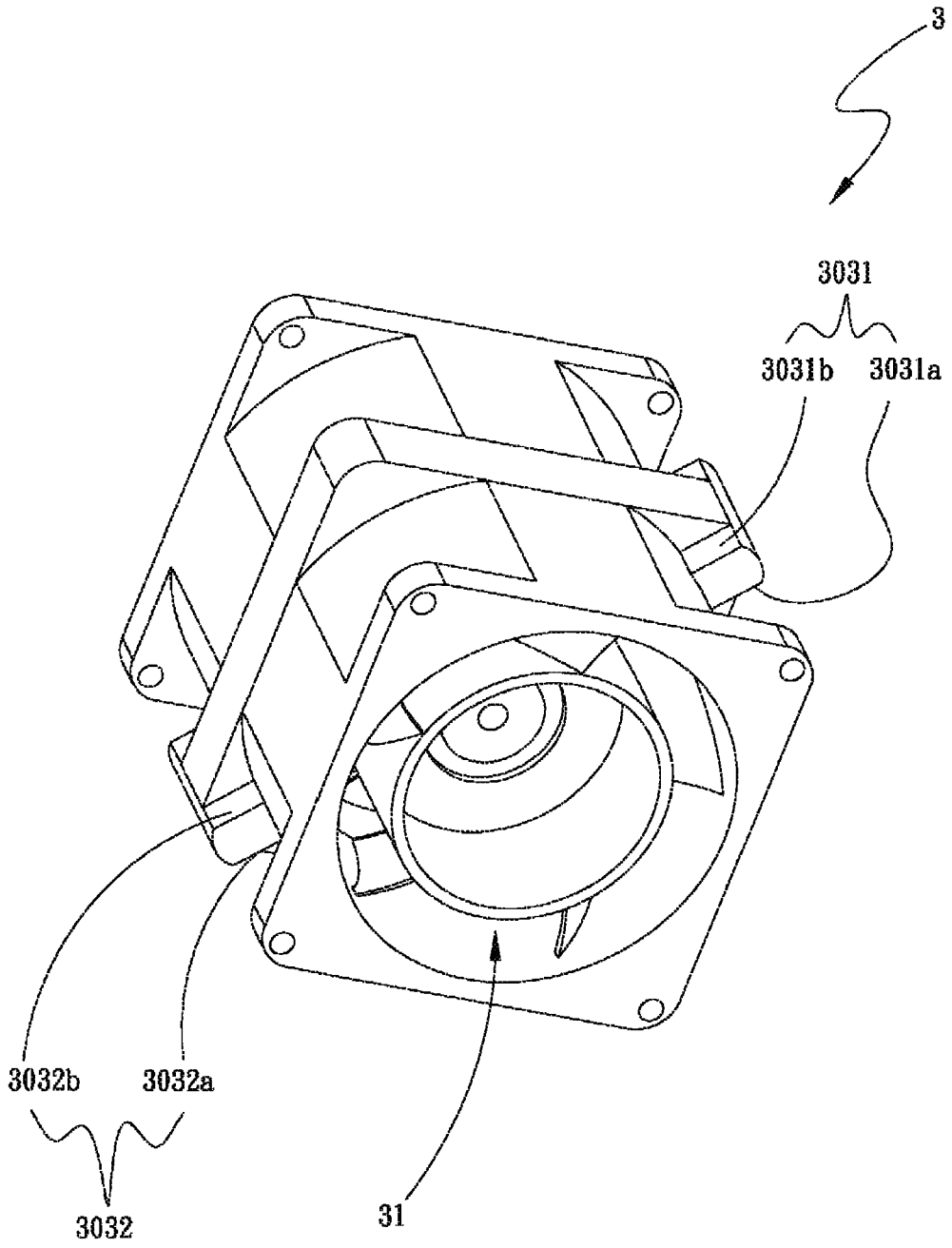
FIG. 4B is an assembled perspective view of the cooling fan structure of FIG. 4A, viewed from a front left side thereof.
Figure 5:
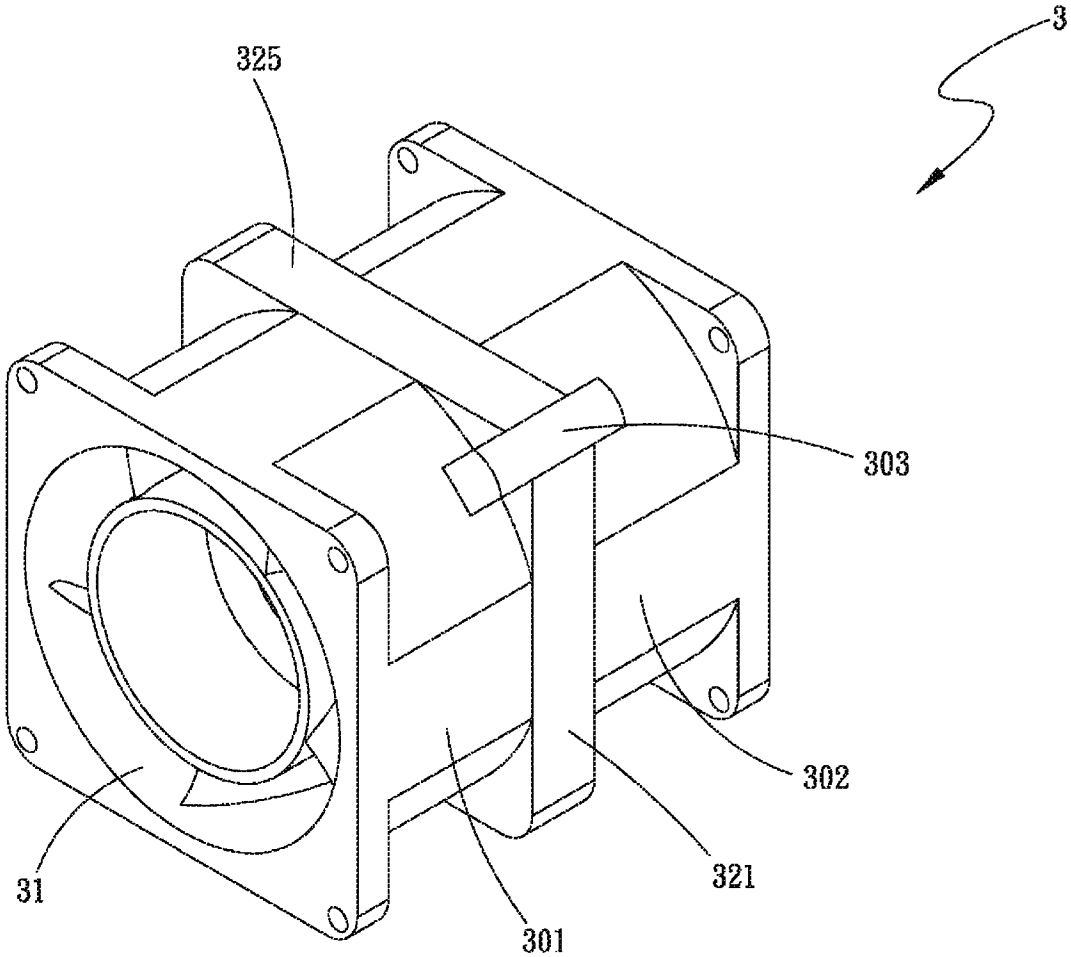
FIG. 5 is an assembled perspective view of the cooling fan structure of FIG. 4A, viewed from a front right side thereof.
Figure 6:
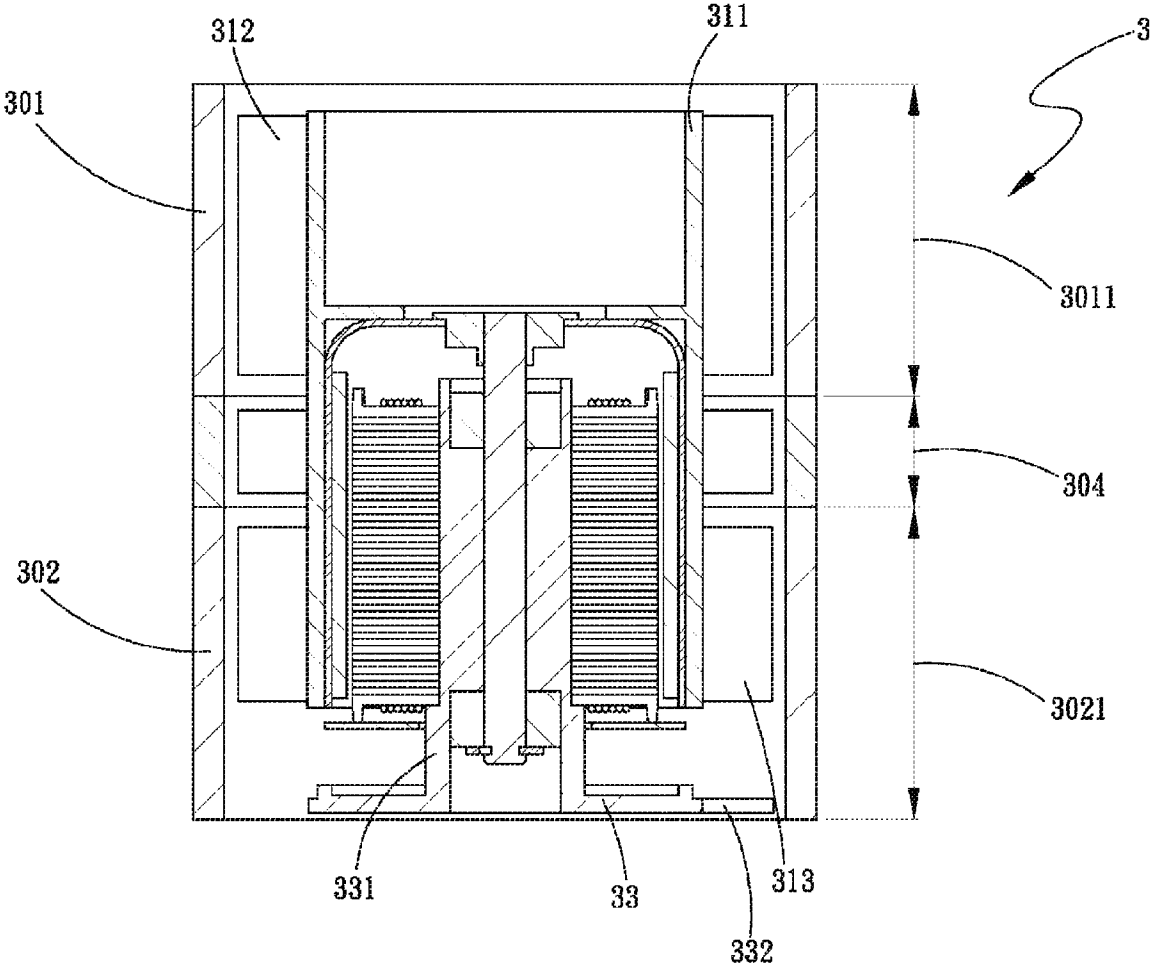
FIG. 6 is an assembled sectional view of the cooling fan structure of FIG. 4A.

The present invention will now be described with some preferred embodiments thereof and by referring to the accompanying drawings. For the purpose of easy to understand, elements that are the same in the preferred embodiments are denoted by the same reference numerals.

Please refer to FIGS. 4A, 4B, 5, and 6, which are exploded and assembled perspective views, and assembled sectional view, respectively, of a cooling fan structure 3 according to a first embodiment of the present invention. As shown, the cooling fan structure 3 includes a housing 30, a multistage fan wheel 31, and a stator-blade unit set 32. The housing 30 is integrally formed and includes a first and a second frame 301, 302, and a connecting spacer set 303 connected to between the first and second frames 301, 302 to space them apart by a predetermined distance and define an open space 304 therebetween.

The first frame 301 internally defines a first receiving space 3011, whereas the second frame 302 internally defines a second receiving space 3021; and the first and the second receiving space 3011, 3012 are axially communicable with the open space 304. A rear end of the second frame 302 opposite to the first frame 301 is provided with a base 33, a central portion of which is forwardly extended to form a bearing cup 331. The base 33 also includes a plurality of supporting portions 332 radially outward extended therefrom. In the illustrated first embodiment, the supporting portions 332 are respectively in the form of a rib.

The connecting spacer set 303 includes a first and a second connecting spacer 3031, 3032, which are located on the housing 30 at two diagonally opposite positions. The first connecting spacer 3031 has a first and a second lateral face 3031*a*, 3031*b*, whereas the second connecting spacer 3032 has a third and a fourth lateral face 3032*a*, 3032*b*.

The multistage fan wheel 31 is located in the housing 30 and fitted around the bearing cup 331, and includes a hub 311 having a group of first rotor blades 312 and a group of second rotor blades 313 formed therearound. The first rotor blades 312 are axially spaced from the second rotor blades 313, such that a bladeless zone 314 is defined around the hub 311 between the first and the second rotor blades 312, 313. The first rotor blades 312 are located in the first receiving space 3011; the second rotor blades 313 are located in the second receiving space 3021; and the bladeless zone 314 is located in the open space 304.

The stator-blade unit set 32 includes a first and a second stator-blade unit 321, 325, which are radially removably assembled into the open space 304 of the housing 30 to circumferentially close the open space 304. The first and the second stator-blade unit 321, 325 respectively have a first and a second inner wall surface 322, 326, and a first and a second free end 324, 328. A plurality of first air-guiding members 323 is provided on the first inner wall surface 322 to radially extend into the open space 304, whereas a plurality of second air-guiding members 327 is provided on the second inner wall surface 326 to radially extend into the open space 304. The first and the second free end 324, 328 are located in the open space 304 corresponding to the bladeless zone 314 of the multistage fan wheel 31.

Two ends of the first stator-blade unit 321 respectively form a first and a second end face 321*a*, 321*b*, whereas two ends of the second stator-blade unit 325 respectively form a third and a fourth end face 325*a*, 325*b*. The first and the second end face 321*a*, 321*b* of the first stator-blade unit 321 are respectively in contact with the first and the third lateral face 3031*a*, 3032*a* of the connecting spacer set 303, whereas the third and the fourth end face 325*a*, 325*b* are respectively in contact with the second and the fourth lateral face 3031*b*, 3032*b* of the connecting spacer set 303.

Please refer to FIGS. 4A, 4B, 5, and 6 again. In the illustrated first embodiment, the first and the second rotor blades 312, 313 are oriented in the same direction, the number of the first and of the second rotor blades 312, 313 are the same, and the first and the second air-guiding member 323, 327 are respectively in the form of a fan blade. With these arrangements, the stator-blade unit set 32 is freely exchangeable according to different impedance systems to achieve different static pressure effects. Therefore, unlike the conventional cooling fan structure, in the present invention, the cost of making a whole new mold for forming a fan frame with a different stator-blade unit set can be saved.

Figure 7:
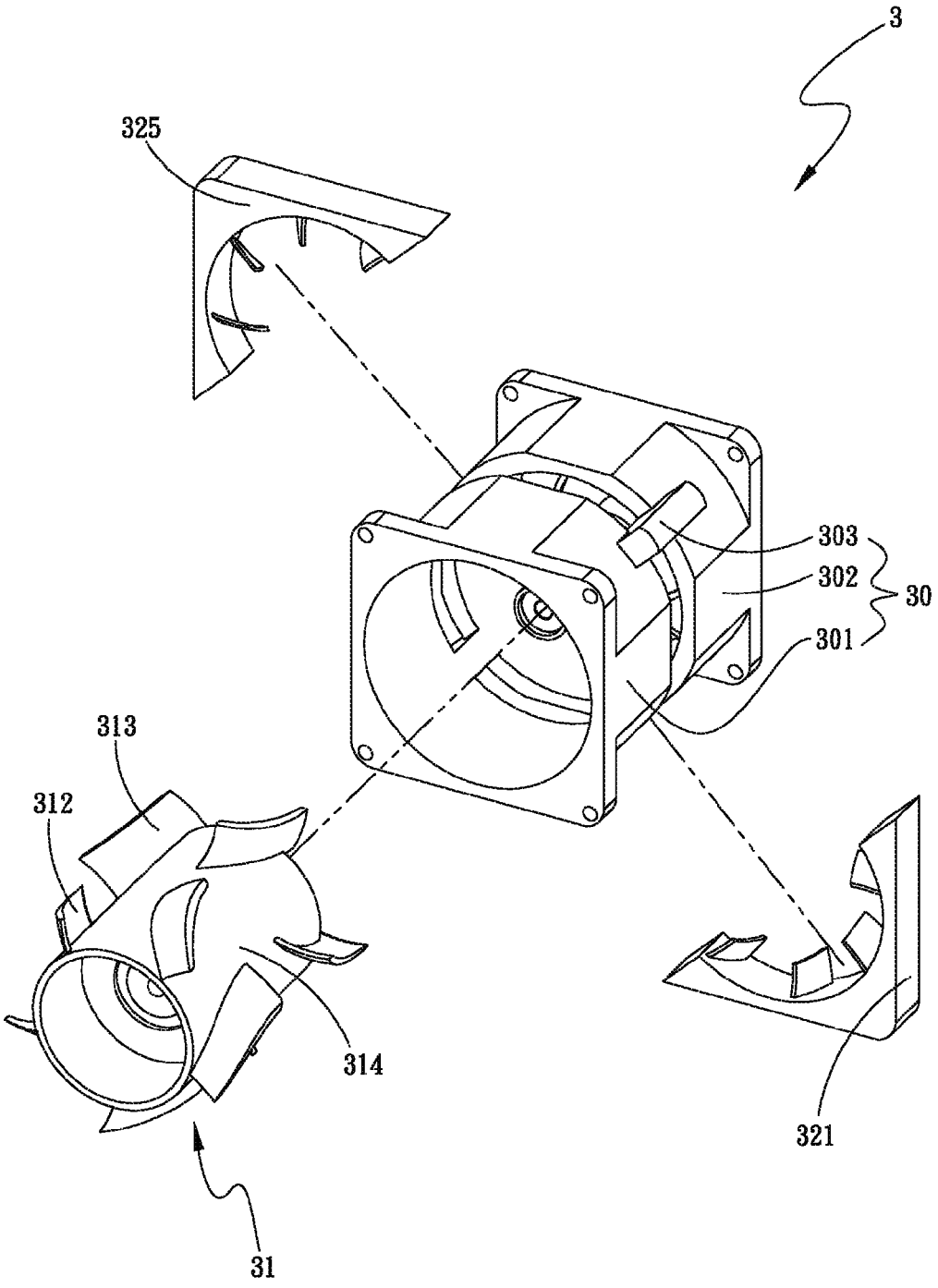
FIG. 7 is an exploded perspective view of the cooling fan structure of the present invention according to a second embodiment thereof.

Please refer to FIG. 7, which is an exploded perspective view of the cooling fan structure according to a second embodiment of the present invention. The cooling fan structure 3 in the second embodiment is generally structurally similar to the first embodiment except that, in this second embodiment, the first and the second rotor blades 312, 313 are oriented in two different directions.

Figure 8:
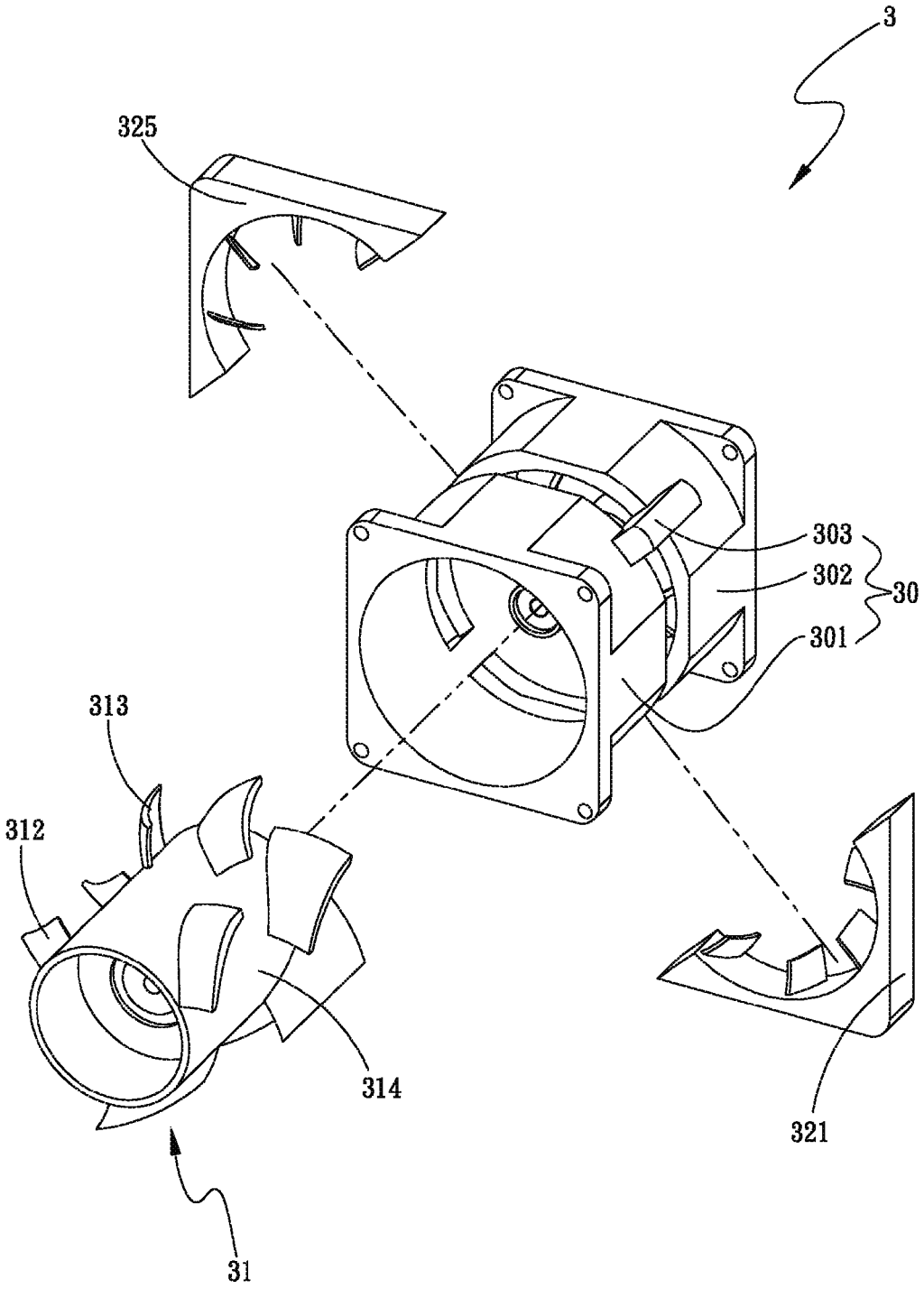
FIG. 8 is an exploded perspective view of the cooling fan structure of the present invention according to a third embodiment thereof.

Please refer to FIG. 8, which is an exploded perspective view of the cooling fan structure according to a third embodiment of the present invention. The cooling fan structure 3 in the third embodiment is generally structurally similar to the first embodiment except that, in this third embodiment, the first and the second rotor blades 312, 313 are different in number, such that the first and the second rotor blades 312, 313 are not correspondingly spaced on the hub 311.

Figure 9:
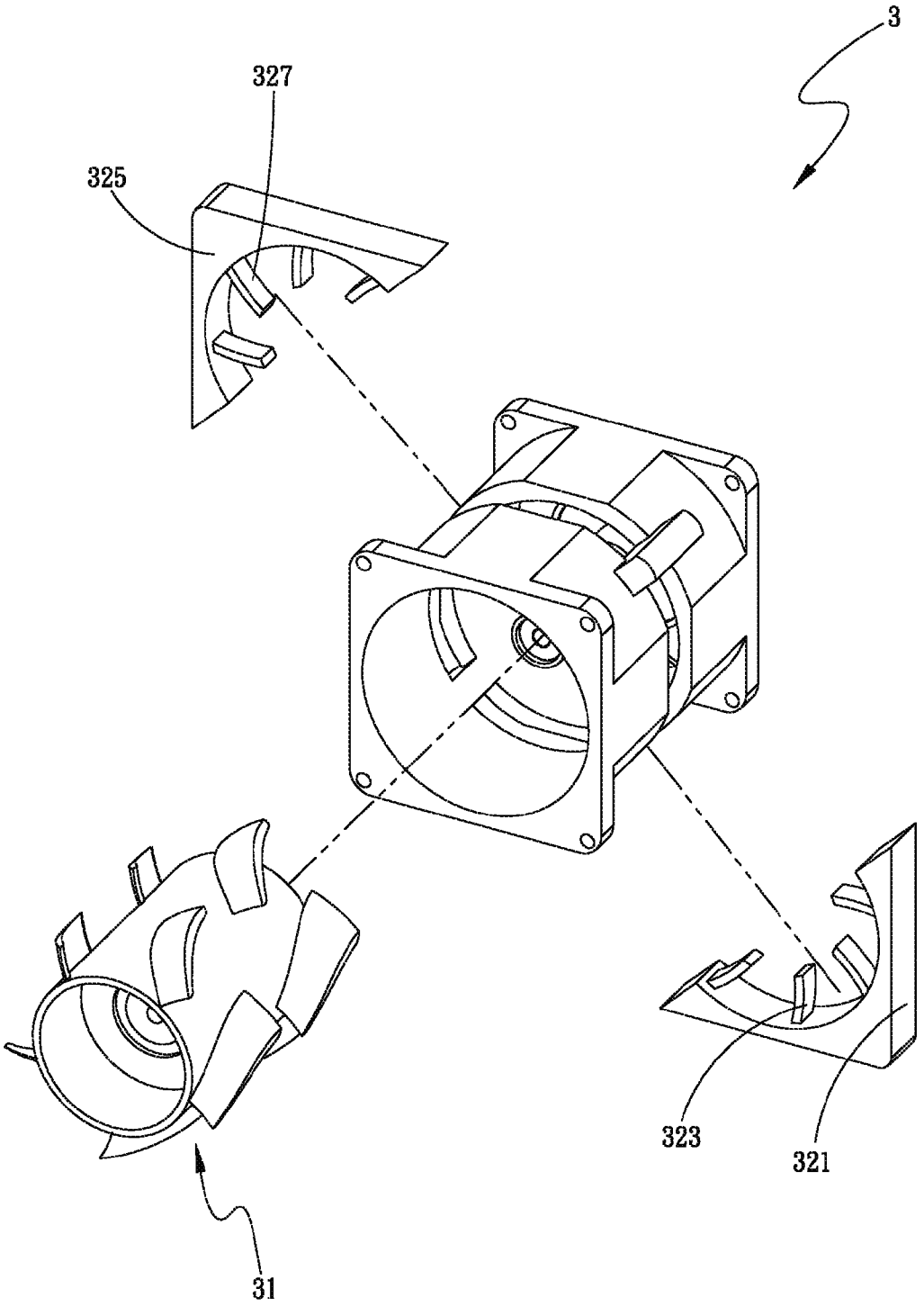
FIG. 9 is an exploded perspective view of the cooling fan structure of the present invention according to a fourth embodiment thereof.

Please refer to FIG. 9, which is an exploded perspective view of the cooling fan structure according to a fourth embodiment of the present invention. The cooling fan structure 3 in the fourth embodiment is generally structurally similar to the first embodiment except that, in this fourth embodiment, the first and the second air-guiding member 323, 327 are respectively in the form of a rib.

Figure 10:
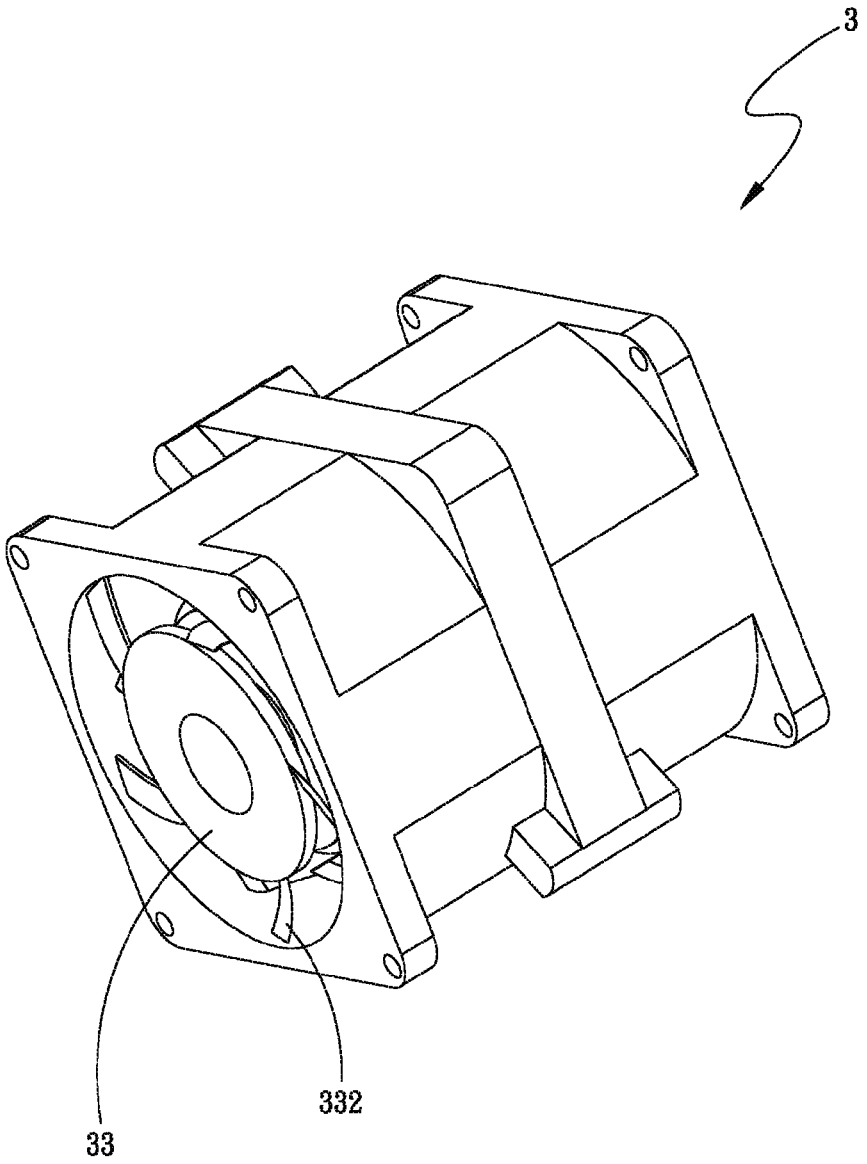
FIG. 10 is an assembled perspective view of the cooling fan structure of the present invention according to a fifth embodiment thereof.

Please refer to FIG. 10, which is an assembled perspective view of the cooling fan structure according to a fifth embodiment of the present invention. The cooling fan structure 3 in the fifth embodiment is generally structurally similar to the first embodiment except that, in this fifth embodiment, the supporting portions 332 outwardly extended from the base 33 are respectively in the form of a fan blade.

Figure 11:
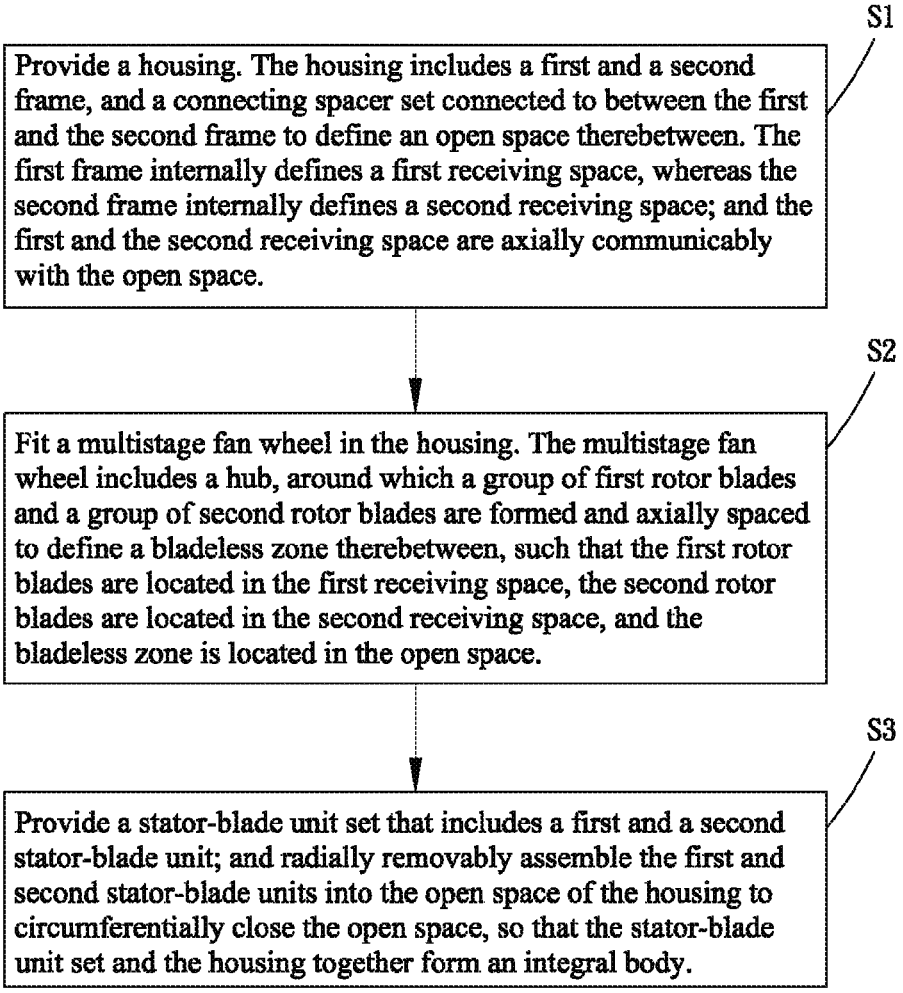
FIG. 11 is a flowchart showing the steps included in a cooling fan assembling method according to a preferred embodiment of the present invention.

Please refer to FIG. 11, which is a flowchart showing the steps S1, S2 and S3 included in a cooling fan assembling method according to a preferred embodiment of the present invention.

In the step S1, a housing is provided. The housing includes a first and a second frame, and a connecting spacer set connected to between the first and the second frame to define an open space therebetween; the first frame internally defines a first receiving space, whereas the second frame internally defines a second receiving space; and the first and the second receiving space are axially communicable with the open space.

More specifically, in the step S1, a housing 30 is provided first. The housing 30 includes a first and a second frame 301, 302, and a connecting spacer set 303 connected to between the first and the second frame 301, 302 to define an open space 304 therebetween. The first and the second frame 301, 302 respectively internally define a first and a second receiving space 3011, 3021, which are axially communicable with the open space 304.

In the step S2, a multistage fan wheel is fitted in the housing. The multistage fan wheel includes a hub, around which a group of first rotor blades and a group of second rotor blades are formed and axially spaced to define a bladeless zone therebetween, such that the first rotor blades are located in the first receiving space, the second rotor blades are located in the second receiving space, and the bladeless zone is located in the open space.

More specifically, in the step S2, a multistage fan wheel 31 is fitted in the housing 30. The multistage fan wheel 31 includes a hub 311, around which a group of first and a group of second rotor blades 312, 313 are formed and axially spaced to define a bladeless zone 314 therebetween, such that the first rotor blades 312 are located in the first receiving space 3011, the second rotor blades 313 are located in the second receiving space 3021, and the bladeless zone 314 is located in the open space 304.

In the step S3, a stator-blade unit set is provided. The stator-blade unit set includes a first and a second stator-blade unit, which are radially removably assembled into the open space of the housing to circumferentially close the open space, so that the stator-blade unit set and the housing together form an integral body.

More specifically, in the step S3, a stator-blade unit set 32 is provided. The stator-blade unit set 32 includes a first and a second stator-blade unit 321, 325, which are radially removably assembled into the open space 304 of the housing 30 to circumferentially close the open space 304, so that the stator-blade unit set 32 and the housing 30 together form an integral body.

According to the above embodiment, the stator-blade unit set 32 is removably connected to the housing 30 by press-fitting. In practical implementation, however, the stator-blade unit set 32 can be removably connected to the housing 30 in other different ways, including but not limited to riveting, snap-fitting, bonding, screwing, and fixing with external elements.

When assembling the cooling fan structure 3 according to the method of the present invention, first fit the multistage fan wheel 31 in the housing 30; and then, provide the first and the second stator-blade unit 321, 325 and radially removably assemble them into the open space 304 of the housing 30 to circumferentially close the open space 304, so that the stator-blade unit set 32 and the housing 30 together form the cooling fan structure 3. In this way, the stator-blade unit set 32 is freely exchangeable according to different high impedance systems to achieve different levels of high static pressure. Therefore, unlike the conventional cooling fan structure, in the present invention, the cost of making a whole new mold for forming another fan frame with a different stator-blade unit set can be saved.

Compared to Taiwan Patent Pub. No. 201416560A, the present invention has provided clear steps, based on which a person of ordinary skill in the art can assemble the stator-blade unit set 32 to the housing 30 to form the cooling fan structure 3 while achieving the aforesaid effects.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A cooling fan structure, comprising:

a housing being integrally formed and including a first frame, a second frame, and a connecting spacer set connected to between the first and second frames to space them apart by a predetermined distance and define an open space therebetween; the first frame internally defining a first receiving space, whereas the second frame internally defining a second receiving space; and the first and the second receiving space being axially communicable with the open space;

a multistage fan wheel being located is in the housing and including a hub, around which a group of first rotor blades and a group of second rotor blades are formed and axially spaced, such that a bladeless zone is defined on the hub between the first and the second rotor blades; the first rotor blades being located in the first receiving space; the second rotor blades being located in the second receiving space; and the bladeless zone being located in the open space;

a stator-blade unit set including a first and a second stator-blade unit, which are radially removably assembled into the open space of the housing to circumferentially close the open space; the first and the second stator-blade unit respectively having a first and a second inner wall surface and a first and a second free end; a plurality of first air-guiding members being provided on the first inner wall surface to radially extend into the open space, whereas a plurality of second air-guiding members being provided on the second inner wall surface to radially extend into the open space; and the first and the second free end being located in the open space corresponding to the bladeless zone of the multistage fan wheel; and wherein the connecting spacer set includes a first and a second connecting spacer, which are located on the housing at two diagonally opposite positions; and the first connecting spacer having a first and a second lateral face, whereas the second connecting spacer having a third and fourth lateral face.

2. The cooling fan structure as claimed in claim 1, wherein the second frame has a rear end located opposite to the first frame and provided with a base; a central portion of the base being forwardly extended to form a bearing cup; and the multistage fan wheel being fitted around the bearing cup.

3. The cooling fan structure as claimed in claim 2, wherein the base includes a plurality of supporting portions radially outward extended from the base; and the supporting portions being selected from the group consisting of ribs and fan blades.

4. The cooling fan structure as claimed in claim 1, wherein the first stator-blade unit has two ends respectively forming a first and a second end face, whereas the second stator-blade unit has two ends respectively forming a third and a fourth end face; the first and the second end face of the stator-blade unit being in contact with the first and the third lateral face of the connecting spacer set, respectively; and the third and the fourth end face being in contact with the second and the fourth lateral face of the connecting spacer set, respectively.

5. The cooling fan structure as claimed in claim 1, wherein the first and the second rotor blades on the hub are oriented in the same direction.

6. The cooling fan structure as claimed in claim 1, wherein the first and the second rotor blades on the hub are oriented in two different directions.

7. The cooling fan structure as claimed in claim 1, wherein the first and the second rotor blades can be the same in number or different in number.

8. The cooling fan structure as claimed in claim 1, wherein the first and the second air-guiding members are selected from the group consisting of fan blades and ribs.

* * * * *